US009554680B2

(12) United States Patent
Elsdon et al.

(10) Patent No.: US 9,554,680 B2
(45) Date of Patent: Jan. 31, 2017

(54) CLEANER HEAD FOR A CLEANING APPLIANCE

(71) Applicant: Dyson Technology Limited, Wiltshire (GB)

(72) Inventors: India Shaw Elsdon, Perth (GB); Simon Peter Cross, Bristol (GB); Timothy Nicholas Stickney, Cirencester (GB)

(73) Assignee: DYSON TECHNOLOGY LIMITED, Malmesbury, Wiltshire (GB)

( * ) Notice: Subject to any disclaimer, the term of this patent is extended or adjusted under 35 U.S.C. 154(b) by 400 days.

(21) Appl. No.: 14/085,304

(22) Filed: Nov. 20, 2013

(65) Prior Publication Data

US 2014/0137366 A1 May 22, 2014

(30) Foreign Application Priority Data

Nov. 21, 2012 (GB) ..... 1220919.3

(51) Int. Cl.
*A47L 9/02* (2006.01)
*A47L 9/04* (2006.01)

(52) U.S. Cl.
CPC .. *A47L 9/02* (2013.01); *A47L 9/04* (2013.01); *A47L 9/0405* (2013.01)

(58) Field of Classification Search
CPC ..... A47L 9/04; A47L 9/02; A47L 9/0405
See application file for complete search history.

(56) References Cited

U.S. PATENT DOCUMENTS

2007/0243961 A1* 10/2007 Aimone ..... F16H 7/0836 474/109
2009/0288268 A1* 11/2009 Courtney ..... A47L 5/28 15/347
2012/0144621 A1 6/2012 Forbes et al.

FOREIGN PATENT DOCUMENTS

| | | |
|---|---|---|
| DE | 10 2008 056 451 | 5/2010 |
| EP | 0 441 320 | 8/1991 |
| EP | 1 136 029 | 9/2001 |
| EP | 1 992 267 | 11/2008 |
| JP | 2013-252255 | 12/2013 |
| JP | 2014-30550 | 2/2014 |
| WO | WO-2012/117231 | 9/2012 |

OTHER PUBLICATIONS

International Search Report and Written Opinion mailed Feb. 24, 2014, directed to International Application No. PCT/GB2013/052997; 10 pages.
Search Report dated Mar. 18, 2013, directed to GB Application No. 1220919.3; 1 page.

* cited by examiner

*Primary Examiner* — Shay Karls
(74) *Attorney, Agent, or Firm* — Morrison & Foerster LLP

(57) ABSTRACT

A cleaner head comprising a main body rotatably coupled to a neck, and a locking arrangement operable to permit rotation of the main body relative to the neck when the cleaner head is positioned on a surface and to prevent rotation of the body relative to the next when the cleaner head is lifted off a surface. The locking arrangement therefore stops the cleaner head from rotating undesirably when the cleaner head is lifted away from a cleaning surface.

8 Claims, 5 Drawing Sheets

CLEANER HEAD FOR A CLEANING APPLIANCE

REFERENCE TO RELATED APPLICATIONS

This application claims priority of United Kingdom Application No. 1220919.3, filed Nov. 21, 2012, the entire contents of which are incorporated herein by reference.

FIELD OF THE INVENTION

The present invention relates to a cleaner head for a cleaning appliance, and is particularly useful in the context of a vacuum cleaning appliance.

BACKGROUND OF THE INVENTION

Surface treating appliances in general, and particularly cylinder-type vacuum cleaners, typically are provided with a cleaner head that can be moved back and forth over a cleaning surface. Sometimes such a cleaner head will have an agitator or 'brush bar' driven by a drive assembly. On a textile covered floor surface, for example, the brush bar works to agitate the floor surface so as to encourage dirt particles to be released from the nap of the carpet, therefore generally improving dirt pick up performance over a 'passive' cleaner head not having a brush bar.

In most cases, the drive assembly comprises an electric motor and a belt to transmit power from the motor to the brush bar. Typically, the transmission belt will engage with one end of the brush bar and so the electric motor will be mounted to one side of the cleaner head so that the transmission belt may have a straight run to the brush bar. Since the motor is mounted off-centre, this generates an out-of-balance torque that tends to rotate the cleaner head relative to its neck as the cleaner head is lifted from the floor during use—this effect becomes particularly pronounced with heavier motors. This 'droop' of the cleaner head can be an annoyance for a user when, during use, the user attempts to 'lift and place' the cleaner head on the floor, for example to traverse steps in the surface or to transition the cleaner head between successive stairs on a staircase. To compensate for this, a user may try and 'lift and place' the cleaner head more quickly which tends to impose greater impact loads on the cleaner head thereby increasing the likelihood of the cleaner head being damaged.

SUMMARY OF THE INVENTION

It is against this background that the invention provides a cleaner head comprising a body rotatably coupled to a neck, and a locking arrangement operable to prevent rotation of the body relative to the next when the cleaner head is lifted off a cleaning surface and to permit rotation of the body relative to the neck when the cleaner head is positioned on a cleaning surface.

By virtue of the locking arrangement, the user may lift the cleaner head without the cleaner head 'droop' that is encountered with some existing cleaner heads. Beneficially, therefore, the cleaner head of the invention increases the user's perception of quality and ease of use. A further benefit is that it avoids the high impacts to which existing cleaner head are subjected by users' struggling to orient the cleaner head correctly on the floor.

The locking arrangement may include an actuator moveable between a first position and a second position, the actuator residing in the first position when the cleaner head is positioned on a cleaning surface and moving to the second position when the cleaner head is lifted away from the cleaning surface.

The locking arrangement may be operable to lock the body in a plurality of angular positions relative to the neck when the cleaner head is lifted away from a cleaning surface. Therefore, the neck may lie at a shallow angle relative to the main body, yet still be locked against rotation when the cleaner head is lifted off of the floor.

In one embodiment, the neck includes a ratchet formation and the locking arrangement includes a pawl that is movable so as to engage and disengage the ratchet formation.

The pawl may be driven by various means, for example it may be driven by an electromechanical actuator such as a lead-screw mechanism. However, in a cost-effective and mechanically elegant embodiment the pawl is carried at a first end of an arm, the arm being pivoted between the first end and a second end, the second end of the arm including a projection that protrudes from a lower surface of the main body when the cleaner head is in a lifted position. The second end of the arm may be weighted appropriately such that it is biased to protrude from the lower surface of the main body. Alternatively, or in addition, the arm may be biased by means on a biasing member such as a spring. The spring may be incorporated into the pivot on which the arm is supported which provides a space-efficient biasing arrangement.

Although the locking arrangement acts to arrest rotation of the main body of the cleaner head relative to the neck when the cleaner head is lifted to an 'off floor' position, it is possible that a user may deliberately or inadvertently force rotation of the main body which may damage the cleaner head. To guard against this, the cleaner head may include an override means such that, in the locked position, the override means is operable to permit rotation of the body relative to the neck when a predetermined torque is applied to the body.

The override means may be provide by is provided by cooperation between the ratchet and pawl, the ratchet including angled contact faces that are complemented by an angled contact face of the pawl, whereby complementary angled contact faces cause the pawl to disengage the ratchet in circumstances when a predetermined torque is applied to the cleaner head.

The invention is applicable particularly to cleaner heads of cleaning appliances which tend to rotate or 'droop' when the cleaner head is lifted up off the floor. For example, it may be the case that the cleaner head includes an agitator that is driven by a drive assembly, which is located towards one side of the cleaner head. In such a configuration, the centre of mass of the cleaner head is remote from a longitudinal centreline of the cleaner head which causes the main body of the cleaner head to move angularly when the cleaner head is lifted. The invention acts to prevent such angular movement of the cleaner head relative to the neck and so improves the usability of the cleaner head.

The drive assembly may include any suitable means to drive to agitator. For example, the drive assembly could include an electric motor, an air turbine, or even a hydraulic drive. Similarly, the drive from the motor may be transmitted to the agitator by a belt or gears for example, although a belt is currently preferred due to its low weight and low cost.

BRIEF DESCRIPTION OF THE DRAWINGS

In order that the present invention may be more readily understood, embodiments of the invention will now be described, by way of example, with reference to the accompanying drawings, in which.

DETAILED DESCRIPTION OF THE INVENTION

Figure 1:
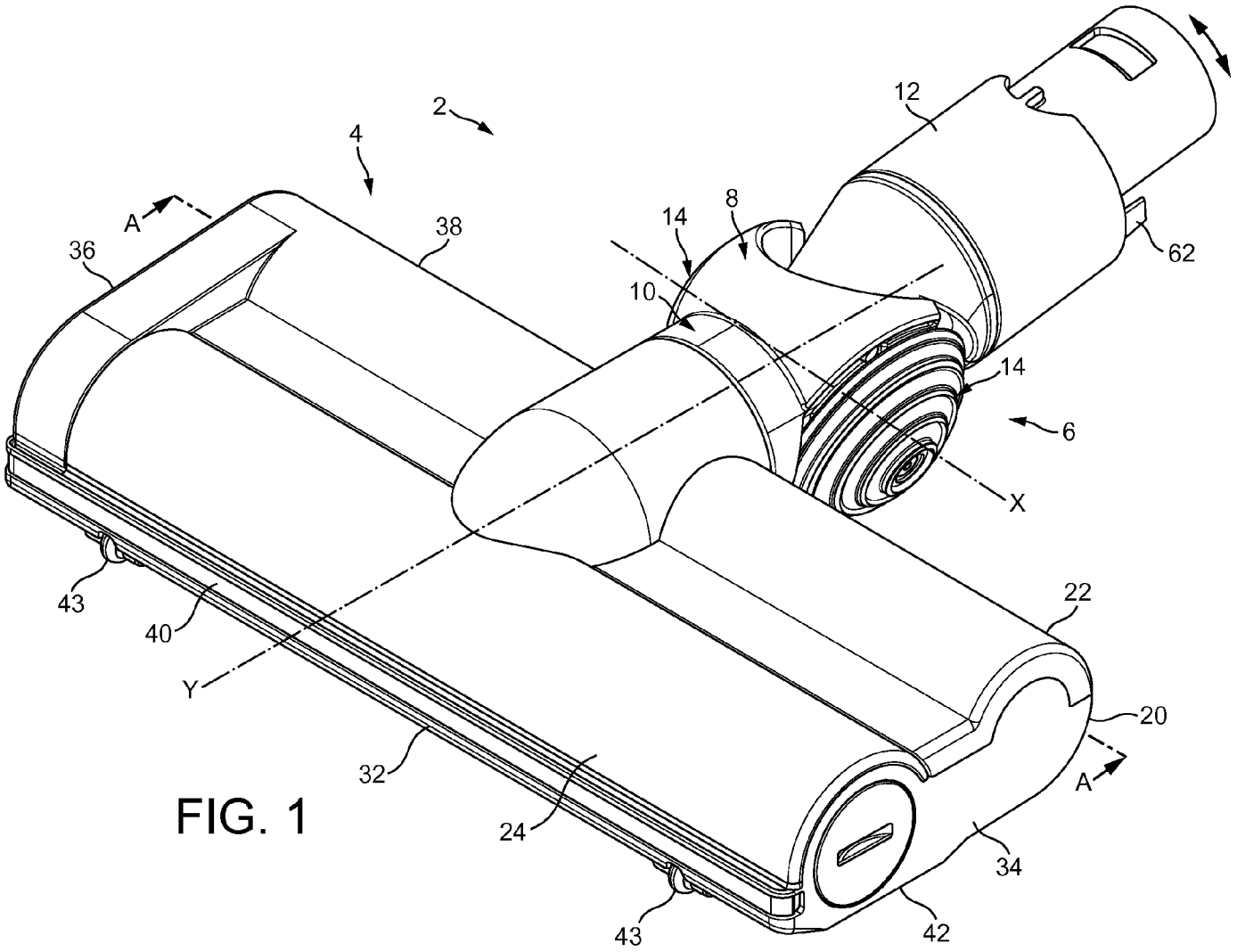
FIG. 1 is a perspective view of a cleaner head in accordance with the invention.
Figure 2:
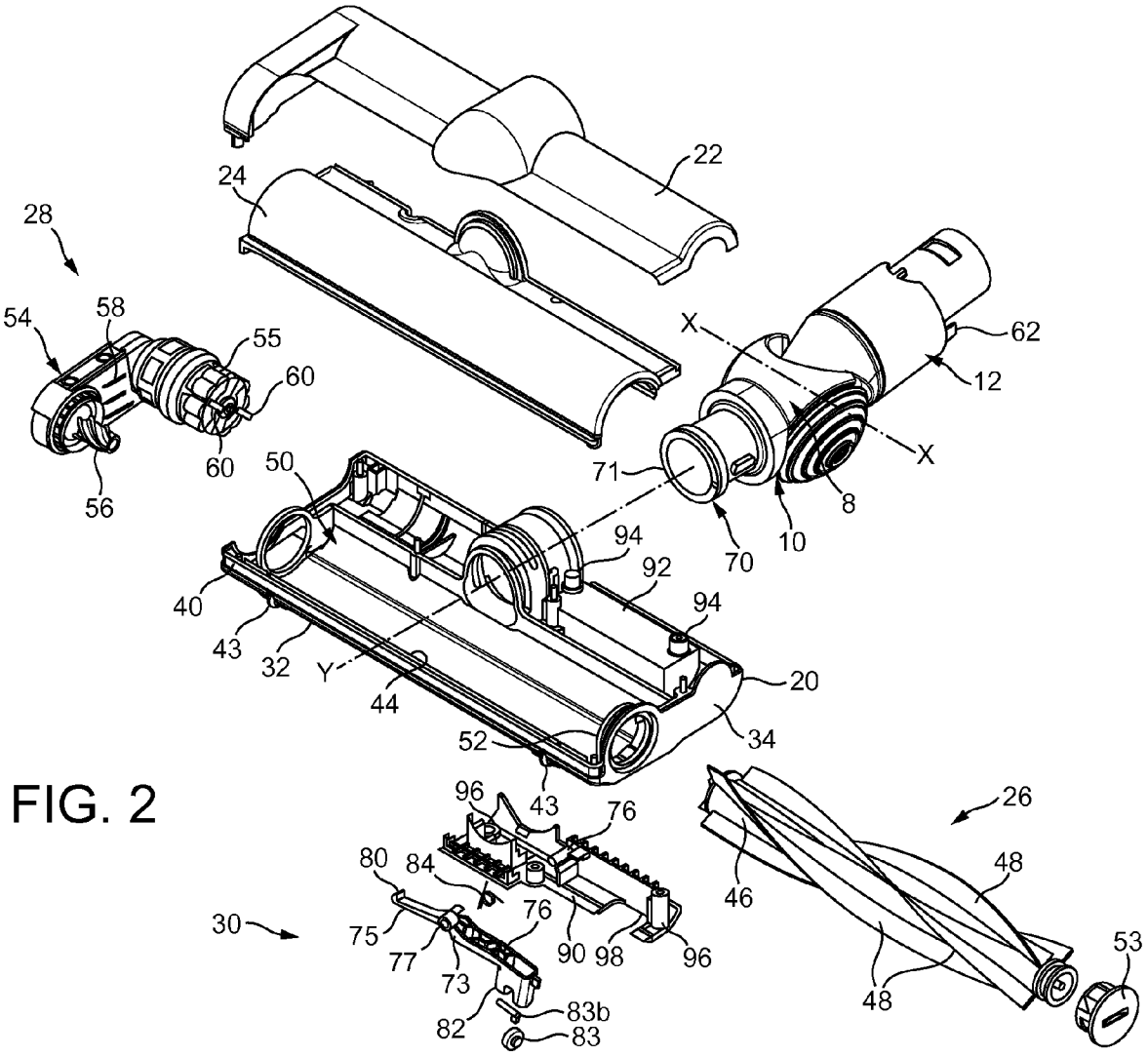
FIG. 2 is an exploded view of the cleaner head in FIG. 1, which shows a locking arrangement.

With reference firstly to FIGS. 1 and 2, a cleaner head 2 comprises a main body 4 and a neck 6 which is configured so as to attach to a suitable vacuum cleaning appliance (not shown). The specific configuration of the neck 6 to enable this connection is not central to the invention and so will not be described further.

A forward portion 8 of the neck 6 is coupled to the main body 4 at a rotatable joint 10 so that the neck 6 can move angularly about a longitudinal axis 'Y' of the main body. A rear portion 12 of the neck 4 is pivotably coupled to the forward neck portion 8 about a lateral axis 'X' that is perpendicular to the longitudinal axis of the 'Y' of the main body.

When the neck 6 is connected to an appropriate hose or wand of a cleaning appliance the pivoting rear neck portion 12 allows a user to incline the wand at a range of angles relative to the main body 4 and the joint 10 allows the wand to rotate relative to the main body. In this way a user can 'steer' the cleaner head 2 around a floor surface. The steering movement is helped by a wheel arrangement 14 comprising a pair of dished or part-spherical wheels which are aligned generally along the lateral axis 'X' and are inclined to vertical. These details of the cleaner head are not the focus of the invention and so further detail will not be provided. Therefore, it will be appreciated that the invention may be used in a cleaner head with a different style of neck.

The main body 4 of the cleaner head comprises a lower housing part 20, and first and second upper housing parts which are labelled as 22 and 24, respectively. These parts are shown separated in FIG. 2 for clarity.

The lower housing part 20 and the upper housing parts 22, 24 define the outer surface of the main body 4 of the cleaner head 2 and house the internal components of the cleaner head 2. In overview, the internal components of the cleaner head 2 are: a rotatable agitator 26, a drive assembly 28 that is configured to rotate the agitator 26, and a locking arrangement 30 that is configured to prevent the main body 4 from rotating relative to the neck 6 when the cleaner head 2 is lifted off of the surface to be cleaned, the structure and functionality of which will be described in detail later.

The housing parts 22, 24 provide the cleaner head 2 with a leading edge 32, first and second generally parallel side faces 34, 36 and a trailing edge 38 that is parallel with the leading edge 32. The leading edge carries a relative soft bumper 40 in the form of a strip of material, for example velour or even rubber, which provides the cleaner head 2 with a degree of protection from impacts as it is pushed around a surface to be cleaned. The profiles of the housing parts 22, 24 are largely dictated by the need to house the agitator 26 and the drive assembly 28 and are shaped accordingly.

The lower housing part 20 has an underside surface defining a sole plate 42 which, in use, faces the surface to be cleaned. The sole plate 42 therefore serves as the interface between the cleaner head 2 and the floor surface and so is shaped to provide a smooth sliding surface. A set of rollers or wheels 43 are provided which, together with the wheel arrangement 14, ensure that the sole plate 42 remains spaced a predetermined distance from a hard surface. However, when the surface is fibrous, such as carpet, the wheels 43 sink into the floor surface so that sole plate 42 glides directly on the surface. Such an arrangement is described in WO2012/117231 the entire contents of which are incorporated herein by reference. It should be noted that the surface to be cleaned is not shown explicitly in FIGS. 1 and 2, although its position relative to the cleaner head 2 in use is illustrated generally as 'F' in FIGS. 3 and 4.

Towards the leading edge 32, the lower housing part 20 defines a generally rectangular aperture or 'suction opening' 44 through which a dirt bearing fluid flow may be drawn into the cleaner head 2 and which allows the agitator 26 to engage an adjacent surface. In this example, the agitator 26 comprises an elongate body 46 to which is attached beater strips or bristles 48 which serve to beat the adjacent floor surface and thus encourage dirt to be released from it. An agitator in this form is commonly referred to a brush bar, or beater bar. Although in this embodiment the agitator 26 takes the form of a rotatable elongate bar, other types of agitator may also be used. For example, a pair of rotating disc-type agitators as described in US2012/0144621, the entire contents of which are incorporated herein by reference, would also serve an equivalent function.

The agitator 26 is housed in an agitator chamber 50 defined partly by the lower housing part 20 and partly by the first upper housing part 22. The upper housing part 22 may be formed from a transparent material which allows a user to visually inspect the interior of the agitator chamber 50 and, therefore, the operating state of the agitator 26. Suitable materials are preferably plastics, such as acrylonitrile butadiene styrene (ABS), polycabonate (PC), or suitable combinations thereof. The agitator chamber 50 is directly above the suction opening 44 so that the beater strips 48 of the agitator 26 extend slightly through the suction opening 44.

In order to drive the agitator 26, one end of it (the left hand end as shown from the front of the cleaner head in FIG. 2) is mounted to the drive assembly 28. The other end of the agitator 26 is mounted to a bush 52 located at the opposite end of the lower housing part 20 to the drive assembly 28. The bush 52 provides a seating for the agitator 26 and also provides an opening through which the agitator 26 can be removed by a user, for example the user may want to remove the brush bar in order to remove hair or thread that has become tangled around it. A cap 53 is removably mounted to the bush 52 by way of a quarter-turn fitment so a user can readily remove the cap 53 without the use of complex tools.

Turning to the driven end of the agitator 26, the drive assembly 28 comprises a transmission 54 which transmits power from a motor 55 to a drive dog 56 which engages the end of the agitator 26. The transmission includes a belt (not shown) that is coupled between the motor 55 and the drive dog 56. Note that the belt is contained within a belt housing 58 of the drive assembly so is not shown explicitly in FIG. 2. A belt transmission system is currently preferred due to simplicity, durability and cost effectiveness, although it should be appreciated that that other transmissions are possible, such as a geared transmission or a hydraulic transmission.

The motor 55 is operable to drive the agitator 26. An electrical supply is provided to the motor 55 by way of electrical connections 60 provided on the inner end of the motor 55, which are arranged to connect to an electrical supply of a vacuum cleaner via a connector 62 on the neck 6 in a manner known in the art. The operation of the motor 55 does not form part of the invention and so will not be described in further detail.

It will be appreciated that the motor 55 is located in a position that is towards one side of the longitudinal axis Y of the main body 4, that is to say the motor 55 is remote from the axis of the main body. In this specific embodiment, the motor 55 is mounted 'off centre' to the left hand side of the neck 6 when the cleaner head is viewed from the front. The off-centre position of the motor 56 applies a torque to the main body 4 tending to move the main body 4 angularly in a counter-clockwise direction about the rotatable joint 10 and the longitudinal axis 'Y'. Therefore, in circumstances where the cleaner head 2 is lifted from the floor surface, the cleaner head will naturally want to 'droop' to the left hand side, which can cause a problem when the cleaner head 2 is placed back on the floor surface since the side of the cleaner head 2 will impact the floor surface first, rather than the sole plate 42 of the cleaner head 2. In circumstances where the main body has rotated through 90 degrees, such that the lateral axis 'A' is perpendicular to the floor, a user may find it awkward to orient the cleaner head 2 correctly on the floor surface.

To alleviate this problem, the locking arrangement 30 is operable to prevent the main body 4 from rotating relative to the neck 6 when the cleaner head 2 is lifted from the surface to be cleaned. In this specific embodiment, the locking arrangement 30 comprises a ratchet formation 70 defined around a portion of the neck and an actuator 73 for releasably engaging the ratchet formation in response to the cleaner head 2 being moved between on-floor and off-floor positions.

Specifically, the ratchet formation 70 is defined at an end 71 of the neck 6 in the region where the neck 6 is coupled to the main body 4 of the cleaner head 2. The ratchet formation 70 comprises a plurality of teeth 72 formed about at least part of the circumference of the tubular neck end 71, and preferably around approximately ninety degrees of arc. In this embodiment, five teeth are provided in total. Although the toothed ratchet formation 70 may be provided around the entire circumference of the neck end 71, in this embodiment the ratchet formation 70 is only provided in a limited portion of the circumference because it is sufficient to perform its function. In this specific embodiment, the ratchet formation extends across one quarter of the neck's circumference. Since there is a plurality of teeth 72 in the ratchet formation 70, the actuator is operable to lock the main body in a plurality of angular positions relative to the neck when the cleaner head is lifted away from a cleaning surface.

The actuator 73 in the form of an arm 74 having first end 75 and a second end 76 and which is rotatably supported at a bearing point 77 on a pivot 78. In this embodiment, the bearing point 77 is at the approximate mid-point of the arm 74. The pivot 78 is provided by an actuator mounting plate 90 which serves to support the actuator arm 74 within the main body 4. The mounting plate 90 is insertable in an open recess of a box-like casing 92 located in the main body 4 and is secured to it by appropriate screws 94 which engage with bosses 96 defined on the mounting plate 90.

The first end 75 of the arm includes a pawl 80 that is operable to engage the ratchet formation 70 and the second end 76 of the arm includes a projecting member or 'trigger' 82 that projects from the sole plate 42 of the cleaner head 2. More specifically, the trigger 82 can protrude through an aperture 98 in the mounting plate 90 and is provided with a roller 83 mounted on an axle **83*b* so that the trigger 82 is able to move smoothly across the floor surface. The actuator 73 is movable between first and second positions depending on whether the cleaner head 2 is in an on-floor or off-floor condition. By way of example, FIG. 3 shows the cleaner head 2 resting on a surface to be cleaned F and FIG. 4** shows the cleaner head lifted off of the surface to be cleaned F.

Figure 3:
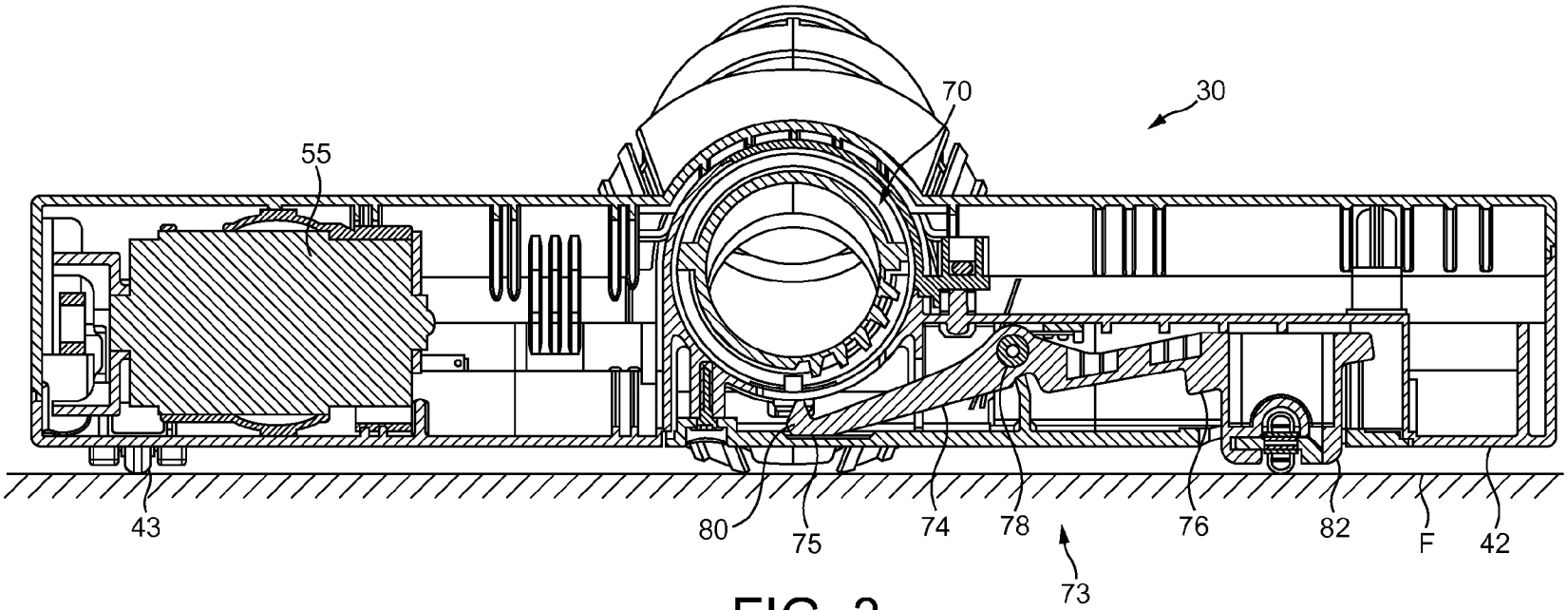
FIG. 3 is a section view of the cleaner head along the line A-A in FIG. 1 which shows the locking arrangement in a first, unlocked, position.

In FIG. 3, the actuator 73 is in its first position (on-floor) in which the floor surface F causes the trigger 82 to retract into the main body 4 of the cleaner head 2 so that the pawl 80 is disengaged from the ratchet formation 70. In this position, therefore, the main body 4 is free to rotate relative to the neck 6 so that a user is able to move the cleaner head 2 over the surface F.

Figure 4:
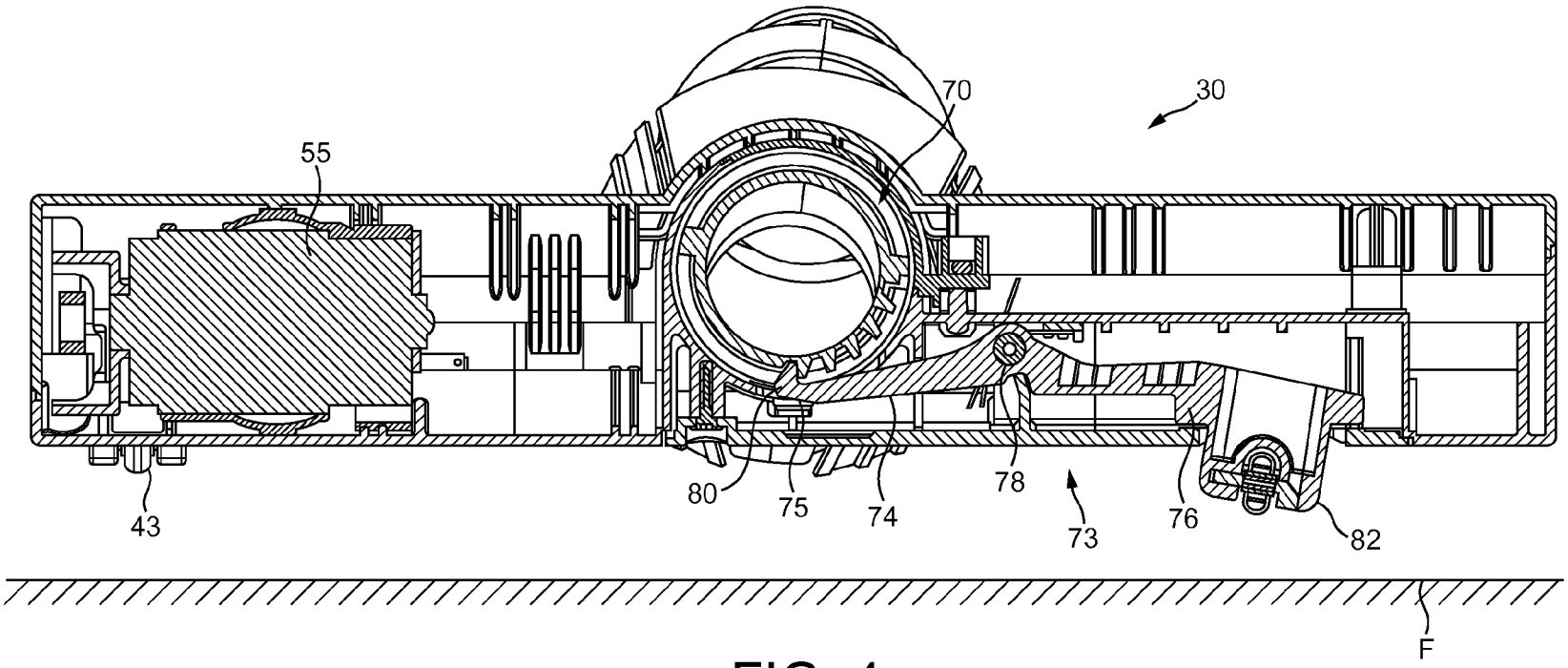
FIG. 4 is a section view like that in FIG. 3 but which shows the locking arrangement in a second, locked, position.

When the cleaner head is lifted off the surface to be cleaned, the actuator 73 is operable to lock the main body 4 so that it cannot move relative to the neck 6. As shown in FIG. 4, the actuator 73 has pivoted clockwise so that the trigger 82 drops through the aperture 98 in the mounting plate 90, thereby causing the pawl 80 to engage the ratchet formation which locks the main body 4 to the neck 6. Note that the actuator 73 is biased into the first position by biasing means which in this embodiment takes the form of a torsion spring 84 located at the pivot 78. Although the actuator 73 is naturally biased into the first position due to the mass of the trigger 82, it is preferred for the actuator to be positively biased so that the actuator tends to the first position in all circumstances, for example if the cleaner head 4 is inverted during use. By virtue of the locking arrangement 30, the user may lift the cleaner head 2 without the 'droop' that is sometimes exhibited with existing cleaner heads. Beneficially, therefore, the cleaner head of the invention increases the user's perception of quality and ease of use. A further benefit is that it avoids high impacts loads which may occur through a user struggling to orient the cleaner head correctly on the floor. It is known that, in an effort to avoid the cleaner head 'drooping', a user may lift the user head off of the floor, but then bring it down quickly and heavily before the cleaner head has had a chance to rotate. This subjects the cleaner head to high impact loads which can increase the risk of damage.

Figure 5:
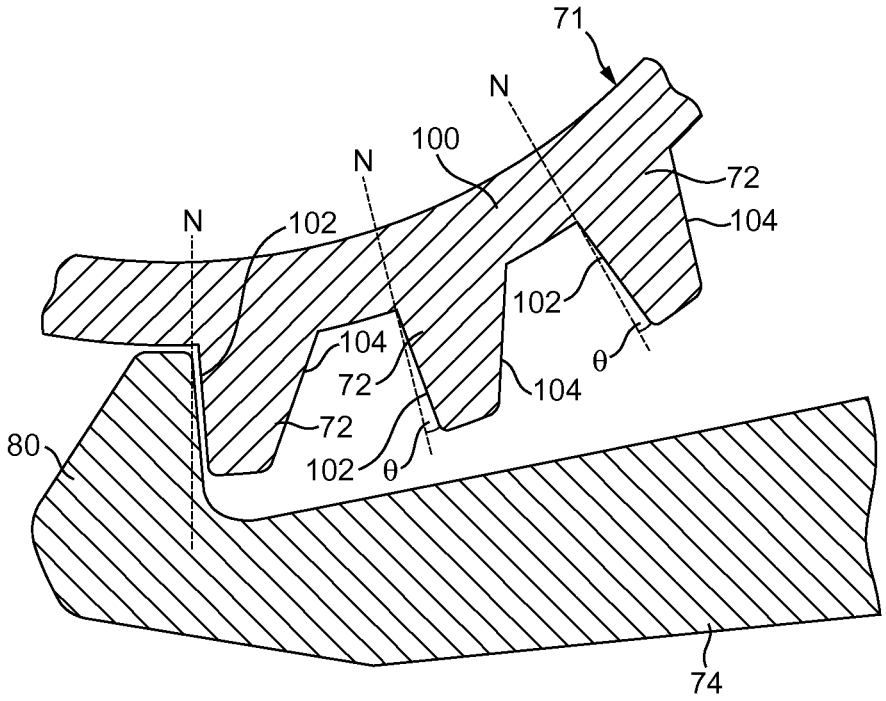
FIG. 5 is an enlarged view of a portion FIG. 4 in the region of the locking arrangement.

It is of course conceivable that a user could either deliberately or inadvertently attempt to force the main body 4 to rotate against the action of the locking arrangement 30. To guard against damage in such a situation, the locking arrangement 30 is configured to 'override' or 'fail safe'. To this end, and with specific reference to FIG. 5, the ratchet formation 70 is shown in an enlarged view including several teeth 72 that project from a base circle 100 defined by the neck end 71. Each tooth 72 includes a rising flank 102 and a falling flank 104, the rising flank 102 being the side face of the tooth 72 which acts against the pawl 80. As is shown, the rising flank 102 of each of tooth 72 is angled with respect to the normal at the point where the rising flank 102 meets the base circle. In FIG. 5, the normal plane to the base circle is illustrated by dashed lines labelled 'N' and the angle between the normal and the rising flank 102 is illustrated by angle θ. Similarly, the pawl also includes an angled contact face.

By virtue of the complementary angled contact flanks 102 of the teeth 72 and the pawl 80 of the actuator 73, the pawl 80 will jump out of engagement with the ratchet formation 70 when the main body 4 is twisted with a predetermined force with respect to the neck 6. This ensures that no components of the cleaner head 2 are damaged inadvertently through rough treatment. The exact angle θ depends on the desired force needed to override the lock between the pawl 80 and the teeth 72 but this is also influenced by the material from which the arm 74 and the teeth 72 are made. For example, for a given angle between pawl 80 and teeth 72, materials with a lower coefficient of friction will tend to 'jump' out of engagement more easily than materials with a higher coefficient of friction. However, currently it is preferred that the angle θ is in the range 4° to 10° which provides a 'release torque' of between approximately 0.9 Nm and 1.6 Nm (Newton meters) for polycarbonate components. Importantly, it should be appreciated that the mechanism only provides a locking force to the cleaner head when the cleaner head is raised off the floor whereas in an on-floor condition, the cleaner head is free to rotate and is not subject to any additional rotational resistance.

The embodiment described above has its centre of mass located towards one side of the cleaner head 2 by virtue of the weight of the motor 55 being positioned remote from the longitudinal axis Y of the cleaner head 2. However, the skilled person will appreciate that the locking arrangement 30 would work also in cleaner heads which did not include a motor but nevertheless have a centre of mass located remote from the centre line/longitudinal axis of the cleaner head.

Whilst the above embodiment has been described as having an electrically powered motor that drives the agitator 26, the invention also covers a drive assembly that is not electrically driven. For example, cleaner heads are known that include agitators driven by air turbines, being driven by dirty air flow drawn through the cleaner head via the suction opening, or by clean air drawn into a dedicated turbine inlet, and the invention should be considered to encompass such schemes.

The locking arrangement 30 in this embodiment is a purely mechanically system. However, the invention may also be embodied by other means, for example a suitable electromechanical system. In an alternative embodiment (not shown), an electromechanical linear actuator may be arranged to drive a pawl or pin to engage and disengage the ratchet formation. Control of the linear actuator may be provided by a miniature snap action switch located in the main body and a trigger mechanism arranged to actuate the snap action switch as the cleaner head is transitioned between on-floor and off-floor conditions.

The invention claimed is:

1. A cleaner head comprising a main body rotatably coupled to a neck, and a locking arrangement operable to permit rotation of the main body relative to the neck when the cleaner head is positioned on a surface and to prevent rotation of the main body relative to the neck when the cleaner head is lifted off a surface, wherein the neck comprises a ratchet formation and the locking arrangement comprises a pawl that is movable so as to engage and disengage the ratchet formation, wherein the pawl is carried at a first end of an arm, the arm being pivotably mounted between the first end and a second end, and wherein the second end of the arm includes a projection that protrudes from a lower surface of the main body when the cleaner head is in a lifted position.

2. The cleaner head of claim 1, wherein the locking arrangement is operable to lock the body in one of a plurality of angular positions relative to the neck when the cleaner head is lifted away from a surface.

3. The cleaner head of claim 1, wherein the locking arrangement includes an override such that, in the locked position, the override is operable to permit rotation of the main body relative to the neck when a predetermined torque is applied to the main body.

4. The cleaner head of claim 1, wherein the locking arrangement includes an override such that, in the locked position, the override is operable to permit rotation of the body relative to the neck when a predetermined torque is applied to the body, wherein the override is provided by cooperation between the ratchet formation and pawl, the ratchet formation including angled contact faces that are complemented by an angled contact face of the pawl, whereby the complementary angled contact faces cause the pawl to disengage the ratchet formation in circumstances when a predetermined torque is applied to the cleaner head.

5. The cleaner head of claim 1, wherein the cleaner head has a centre of mass that is located towards one side of a longitudinal centre line of the cleaner head.

6. The cleaner head of claim 1, including an agitator and a drive assembly for driving the agitator.

7. The cleaner head of claim 6, wherein the drive assembly is an electric motor or an air turbine.

8. The cleaner head of claim 6, wherein the drive assembly is located off centre within the cleaner head.

* * * * *